US008439110B2

(12) United States Patent
Corre et al.

(10) Patent No.: US 8,439,110 B2
(45) Date of Patent: May 14, 2013

(54) SINGLE PACKER SYSTEM FOR USE IN HEAVY OIL ENVIRONMENTS

(75) Inventors: Pierre-Yves Corre, Eu (FR); Stephen Yeldell, Sugar Land, TX (US); Carsten Sonne, Houston, TX (US); Anthony Robert Holmes Goodwin, Sugar Land, TX (US); Stephane Briquet, Yokohama (JP); Alexander F. Zazovsky, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 13/190,340

(22) Filed: Jul. 25, 2011

(65) Prior Publication Data

US 2011/0277999 A1 Nov. 17, 2011

Related U.S. Application Data

(63) Continuation of application No. 12/357,133, filed on Jan. 21, 2009, now Pat. No. 8,162, 052.

(60) Provisional application No. 61/022,996, filed on Jan. 23, 2008.

(51) Int. Cl.

| | |
|---|---|
| ***E21B 49/00*** | (2006.01) |
| ***E21B 49/08*** | (2006.01) |
| ***E21B 36/00*** | (2006.01) |
| ***E21B 43/24*** | (2006.01) |

(52) U.S. Cl.

USPC ..... 166/250.17; 166/264; 166/60; 166/61; 166/57

(58) Field of Classification Search ..... 166/264, 166/188, 250.17, 60, 61, 57; 73/152.26

See application file for complete search history.

(56) References Cited

U.S. PATENT DOCUMENTS

| | | | |
|---|---|---|---|
| 2,581,070 | A | 1/1950 | Blood |
| 2,693,342 | A | 11/1954 | Lynes |
| 2,843,208 | A | 7/1958 | Blood |
| 3,104,712 | A | 9/1963 | Whitten |
| 3,859,851 | A | 1/1975 | Urbanosky |
| 3,899,631 | A | 8/1975 | Clark |

(Continued)

FOREIGN PATENT DOCUMENTS

| | | | |
|---|---|---|---|
| GB | 2404403 | A | 2/2005 |
| GB | 2418938 | A | 4/2006 |

(Continued)

OTHER PUBLICATIONS

Burgess, K., Fields, T., Harrigan, E., Golich, G.M., MacDougall, T., Reeves, R., Smith, S., Thornsberry, K., Ritchie, B., Rivero, R., and Siegfried, R., "Formation Testing and Sampling Through Casing", Oilfield Review, Schlumberger, Spring 2002: pp. 46-57.

(Continued)

*Primary Examiner* — Cathleen Hutchins
(74) *Attorney, Agent, or Firm* — John Vereb

(57) ABSTRACT

A technique involves collecting formation fluids through a single packer having at least one drain located within the single packer. The single packer comprises an outer seal layer, and the at least one drain is positioned in the outer seal layer. A viscosity system also is incorporated and enables the viscosity of a surrounding fluid to be selectively lowered for sampling.

20 Claims, 7 Drawing Sheets

U.S. PATENT DOCUMENTS

| | | | |
|---|---|---|---|
| 4,127,169 | A | 11/1978 | Tubin et al. |
| 4,353,249 | A | 10/1982 | Lagus et al. |
| 4,392,376 | A | 7/1983 | Lagus et al. |
| 4,485,868 | A | 12/1984 | Sresty et al. |
| 4,860,581 | A | 8/1989 | Zimmerman et al. |
| 4,936,139 | A | 6/1990 | Zimmerman et al. |
| 5,056,595 | A | 10/1991 | Desbrandes |
| 5,233,866 | A | 8/1993 | Desbrandes |
| 6,065,544 | A | 5/2000 | Holbert |
| 6,208,316 | B1 | 3/2001 | Cahill |
| 6,269,882 | B1 | 8/2001 | Wellington et al. |
| 6,301,959 | B1 | 10/2001 | Hrametz et al. |
| 6,699,019 | B2 | 3/2004 | Myers et al. |
| 6,755,246 | B2 | 6/2004 | Chen et al. |
| 6,766,854 | B2 | 7/2004 | Ciglenec et al. |
| 7,347,262 | B2 | 3/2008 | Tarvin et al. |
| 7,380,599 | B2 | 6/2008 | Fields et al. |
| 7,878,243 | B2 | 2/2011 | Goodwin et al. |
| 8,016,038 | B2 | 9/2011 | Goodwin et al. |
| 8,162,052 | B2 | 4/2012 | Goodwin et al. |
| 2003/0034777 | A1 | 2/2003 | Chen et al. |
| 2003/0217845 | A1 | 11/2003 | Sherwood et al. |
| 2004/0093937 | A1 | 5/2004 | Hashem |
| 2004/0104341 | A1 | 6/2004 | Betancourt et al. |
| 2005/0155760 | A1 | 7/2005 | Hill et al. |
| 2005/0279499 | A1 | 12/2005 | Tarvin et al. |
| 2006/0042793 | A1 | 3/2006 | Del Campo et al. |
| 2006/0137873 | A1 | 6/2006 | Caudwell et al. |
| 2006/0155472 | A1 | 7/2006 | Venkataramanan et al. |
| 2006/0162935 | A1 | 7/2006 | MacDougall |
| 2006/0248949 | A1 | 11/2006 | Gregory et al. |
| 2007/0215348 | A1 | 9/2007 | Corre et al. |
| 2008/0066904 | A1 | 3/2008 | Van Hal et al. |
| 2008/0078581 | A1 | 4/2008 | Goodwin et al. |
| 2008/0115575 | A1* | 5/2008 | Meek et al. ..... 73/152.24 |
| 2008/0156486 | A1 | 7/2008 | Ciglenec et al. |
| 2009/0008079 | A1 | 1/2009 | Zazovsky et al. |
| 2009/0091320 | A1* | 4/2009 | Flaum et al. ..... 324/303 |
| 2009/0159278 | A1 | 6/2009 | Corre et al. |
| 2010/0071898 | A1* | 3/2010 | Corre et al. ..... 166/264 |

FOREIGN PATENT DOCUMENTS

| | | | |
|---|---|---|---|
| GB | 2420135 | A | 5/2006 |
| GB | 2431673 | A | 5/2007 |
| GB | 2445846 | A | 7/2008 |
| WO | 03016826 | A2 | 2/2003 |
| WO | 2007048991 | A1 | 5/2007 |
| WO | 2008036520 | A1 | 3/2008 |
| WO | 2008150825 | A1 | 12/2008 |

OTHER PUBLICATIONS

International Search Report and Written Opinion of PCT Application No. PCT/US2009/032585 dated May 25, 2009: pp. 1-9.

International Search Report and Written Opinion of PCT Application No. PCT/US2009/031635 dated May 25, 2010: 1-8.

International Preliminary Report on Patentability and Written Opinion of PCT Application No. PCT/US2009/031635 dated Jul. 27, 2010: pp. 1-6.

International Preliminary Report on Patentability and Written Opinion of PCT Application No. PCT/US2009/032585 dated Aug. 10, 2010: pp. 1-7.

CIPO Exam Report of Canadian Application No. 2713396 dated Jun. 13, 2012: pp. 1-9.

CIPO Exam Report of Canadian Application No. 2714501 dated Jun. 15, 2012: pp. 1-5.

* cited by examiner

SINGLE PACKER SYSTEM FOR USE IN HEAVY OIL ENVIRONMENTS

CROSS REFERENCE TO RELATED APPLICATIONS

The present document is a continuation application of U.S. patent application Ser. No. 12/368,738, filed on Feb. 10, 2009 (hereinafter "the '738 Application"), which is a continuation-in-part of U.S. patent application Ser. No. 12/357,133, filed on Jan. 21, 2009, which in turn claims the benefit of U.S. Provisional Patent Application Ser. No. 61/022,996, filed on Jan. 23, 2008, the entire disclosures of each of which are incorporated herein by reference.

The '738 Application is also a continuation-in-part of co-pending U.S. patent application Ser. No. 12/361,640, filed on Jan. 29, 2009, which in turn claims the benefit of U.S. Provisional Patent Application Ser. No. 61/027,122, filed on Feb. 8, 2008, the entire disclosures of each of which are incorporated herein by reference.

The '738 Application is also a continuation-in-part of co-pending U.S. patent application Ser. No. 11/763,237, filed on Jun. 14, 2007, which in turn claims the benefit of U.S. Provisional Patent Application Ser. No. 60/882,701, filed on Dec. 29, 2006, the entire disclosures of each of which are incorporated herein by reference.

BACKGROUND

A variety of packers are used in wellbores to isolate specific wellbore regions. A packer is delivered downhole on a conveyance and expanded against the surrounding wellbore wall to isolate a region of the wellbore. Often, two or more packers can be used to isolate one or more regions in a variety of well related applications, including production applications, service applications and testing applications. In some applications, a straddle packer is used to isolate a specific region of the wellbore to allow collection of fluid samples. However, straddle packers use a dual packer configuration in which fluids are collected between two separate packers. The dual packer configuration is susceptible to mechanical stresses which limit the expansion ratio and the drawdown pressure differential that can be employed. Other multiple packer techniques can be expensive and present additional difficulties in collecting samples and managing fluid flow in the wellbore environment. Furthermore, many of these techniques can be difficult to employ in heavy oil environments.

SUMMARY

In general, the present invention provides a system and method for collecting formation fluids through a single packer having at least one drain located within the single packer. The single packer comprises an outer seal layer, and the at least one drain is positioned in the outer seal layer. A viscosity system also is incorporated into the single packer and enables the viscosity of a surrounding substance, e.g. oil, to be selectively lowered for sampling.

BRIEF DESCRIPTION OF THE DRAWINGS

Certain embodiments of the invention will hereafter be described with reference to the accompanying drawings, wherein like reference numerals denote like elements, and.

DETAILED DESCRIPTION

Figure 1:
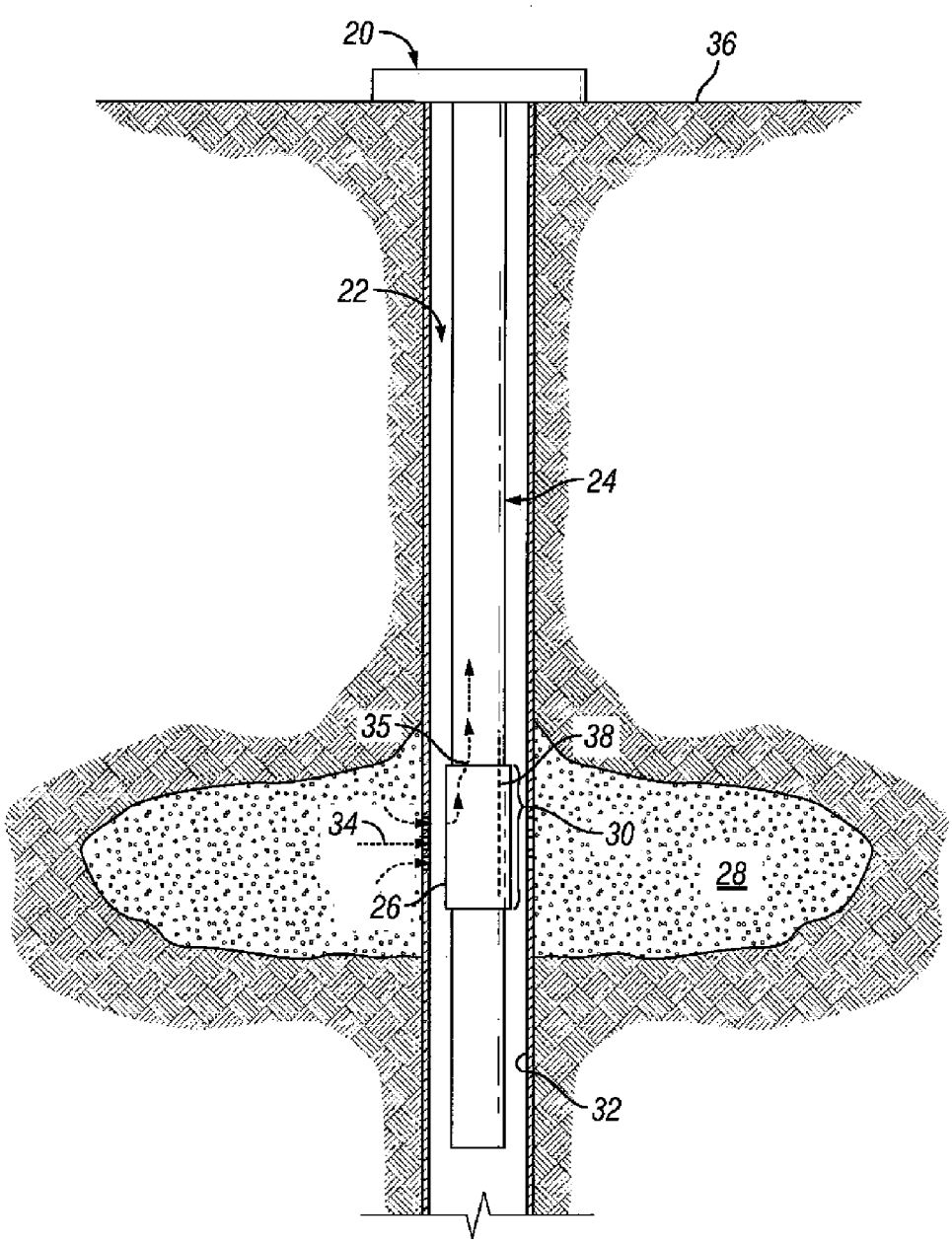
FIG. 1 is a schematic front elevation view of a well system having a single packer through which formation fluids can be collected, according to an embodiment of the present invention.

In the following description, numerous details are set forth to provide an understanding of the present invention. However, it will be understood by those of ordinary skill in the art that the present invention may be practiced without these details and that numerous variations or modifications from the described embodiments may be possible.

The present invention generally relates to a system and method for collecting formation fluids through a drain located in a single packer. Formation fluid samples are collected through an outer layer of the single packer and conveyed to a desired collection location. Use of the single packer enables larger expansion ratios and higher drawdown pressure differentials. Additionally, the single packer configuration reduces the stresses otherwise incurred by the packer tool mandrel due to the differential pressures. In some embodiments, the packer uses a single expandable sealing element which renders the packer better able to support the formation in a produced zone at which formation fluids are collected. This quality facilitates relatively large amplitude draw-downs even in weak, unconsolidated formations. The single packer further comprises a viscosity lowering system to facilitate use of the single packer in, for example, heavy oil environments.

The single packer expands across an expansion zone, and formation fluids can be collected from the middle of the expansion zone, i.e. between axial ends of the outer sealing layer. The formation fluid collected is directed along flow lines, e.g. along flow tubes, having sufficient inner diameter to allow operations in a variety of environments. Formation fluid can be collected through one or more drains. For example, separate drains can be disposed along the length of the packer to establish collection intervals or zones that enable focused sampling at a plurality of collecting intervals, e.g. two or three collecting intervals. Separate flowlines can be connected to different drains, e.g. sampling drains and guard drains, to enable the collection of unique formation fluid samples.

The single packer incorporates the viscosity lowering system to enable collection of samples with otherwise relatively high viscosities. The viscosity lowering system enables reduction of the viscosity of heavy oils or other substances to be sampled in a subterranean environment. In some embodiments, the viscosity lowering system generally comprises a heating system to heat the formation region surrounding a sampling drain and/or to heat an interior region of the single packer to facilitate flow. The heating system may comprise, for example, heating elements, heated fluid injection systems, microwave emitters, and other components able to increase the temperature of the desired substance to be sampled. Other viscosity lowering systems may comprise injection systems used to inject a diluent that decreases the viscosity of the substance to be sampled. Combinations of viscosity lowering systems also can be used to facilitate sampling in the subterranean region.

Referring generally to FIG. 1, one embodiment of a well system 20 is illustrated as deployed in a wellbore 22. The well system 20 comprises a conveyance 24 employed to deliver at least one packer 26 downhole. In many applications, packer 26 is deployed by conveyance 24 in the form of a wireline, but conveyance 24 may have other forms, including tubing strings, for other applications. In the embodiment illustrated, packer 26 is a single packer configuration used to collect formation fluids from a surrounding formation 28. The single packer 26 is selectively expanded in a radially outward direction to seal across an expansion zone 30 with a surrounding wellbore wall 32, such as a surrounding casing or open wellbore wall. When packer 26 is expanded to seal against wellbore wall 32, formation fluids can be flowed into packer 26, as indicated by arrows 34. The formation fluids are then directed to a flow line, as represented by arrows 35, and produced to a collection location, such as a location at a well site surface 36. A viscosity lowering system 38 is incorporated into the single packer 26 to enable selective lowering of the viscosity of a substance, e.g. oil, to be sampled through single packer 36.

Figure 2:
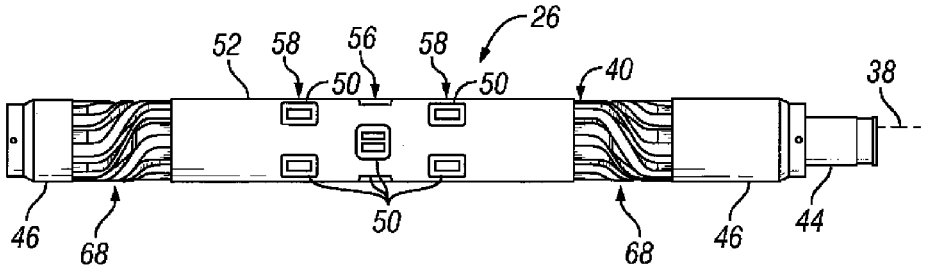
FIG. 2 is a front view of one example of the single packer illustrated in FIG. 1, according to an embodiment of the present invention.
Figure 3:
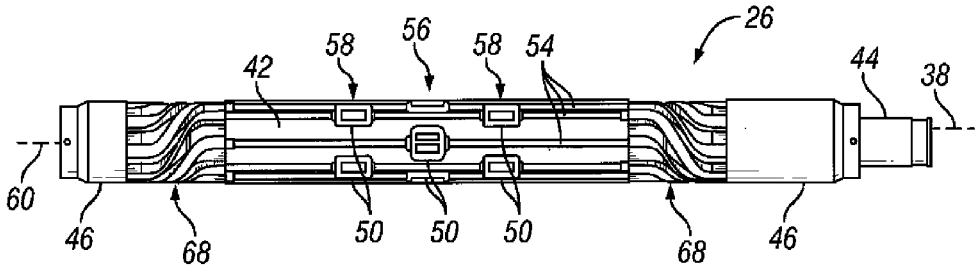
FIG. 3 is a view similar to that of FIG. 2 but showing internal components of an outer structural layer, according to an embodiment of the present invention.

Referring generally to FIGS. 2 and 3, one embodiment of single packer 26 is illustrated. In this embodiment, packer 26 comprises an outer structural layer 40 that is expandable in a wellbore to form a seal with surrounding wellbore wall 32 across expansion zone 30. The single packer 26 further comprises an inner, inflatable bladder 42 disposed within an interior of outer structural layer 40. The inflatable bladder 42 can be formed in several configurations and with a variety of materials, such as a rubber layer having internal cables. In one example, the inner bladder 42 is selectively expanded by fluid delivered via an inner mandrel 44. Furthermore, packer 26 comprises a pair of mechanical fittings 46 that are mounted around inner mandrel 44 and engaged with axial ends 48 of outer structural layer 40. It should be noted that single packer 26 can utilize other expansion mechanisms in combination with viscosity lowering system 38.

In the embodiment illustrated, outer structural layer 40 comprises one or more drains 50 through which formation fluid is collected when outer layer 40 is expanded to seal the single packer 26 against surrounding wellbore wall 32. Drains 50 may be embedded radially into a sealing element or seal layer 52 that surrounds outer structural layer 40. By way of example, sealing layer 52 may be cylindrical and formed of an elastomeric material selected for hydrocarbon based applications, such as nitrile rubber (NBR), hydrogenated nitrile butadiene rubber (HNBR), and fluorocarbon rubber (FKM). As described in greater detail below, some embodiments of viscosity lowering system 38 may comprise heating elements deployed in seal layer 52. Additionally, the seal layer 52 may be formed from a thermally conductive material, such as a thermally conductive rubber, to increase the efficiency of the heating elements.

A plurality of tubular members or tubes 54 may be operatively coupled with drains 50 for directing the collected formation fluid in an axial direction to one or both of the mechanical fittings 46. In one example, alternating tubes 54 are connected either to a central drain or drains, e.g. sampling drains 56, or to axially outer drains, e.g. guard drains 58, located on both axial sides of the middle sampling drains. The guard drains 58 can be located around the sampling drains 56 to achieve faster fluid cleaning during sampling. As further illustrated in FIG. 3, tubes 54 can be aligned generally parallel with a packer axis 60 that extends through the axial ends of outer structural layer 40. In some embodiments, tubes 54 may be at least partially embedded in the material of sealing element 52 and thus move radially outward and radially inward during expansion and contraction of outer layer 40.

Figure 4:
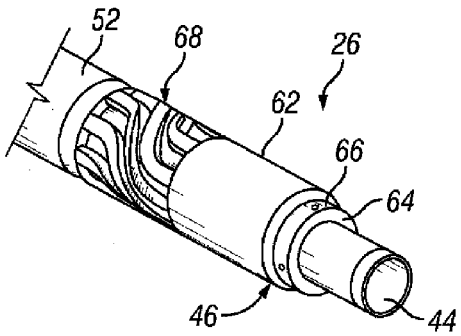
FIG. 4 is an orthogonal view of an end of the packer illustrated in FIG. 2 in a contracted configuration, according to an embodiment of the present invention.
Figure 5:
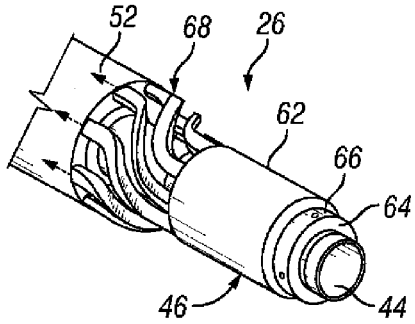
FIG. 5 is an orthogonal view similar to that of FIG. 4 but showing the packer in an expanded configuration, according to an embodiment of the present invention.

Referring generally to FIGS. 4 and 5, an embodiment of mechanical fittings 46 is illustrated in both a contracted configuration (FIG. 4) and an expanded configuration (FIG. 5). In this embodiment, each mechanical fitting 46 comprises a collector portion 62 having an inner sleeve 64 and an outer sleeve 66 that are sealed together. Each collector portion 62 can be ported as desired to deliver fluid collected from the surrounding formation to a desired flow system for transfer to a collection location. One or more movable members 68 are movably coupled to each collector portion 62, and at least some of the movable members 68 are used to transfer collected fluid from tubes 54 into the collector portion 62. By way of example, each movable member 68 may be pivotably coupled to its corresponding collector portion 62 for pivotable movement about an axis generally parallel with packer axis 60.

In the embodiment illustrated, a plurality of movable members 68 are pivotably mounted to each collector portion 62. At least some of the movable members 68 are designed as flow members that allow fluid flow between tubes 54 and collector portions 62. Certain movable flow members 68 can be coupled to tubes 54 extending to sampling drains 56, while other movable flow member 68 can be coupled to tubes 54 extending to guard drains 58 to enable separation of guard drain flow and sampling drain flow. In this example, movable flow members 68 are generally S-shaped and designed for pivotable connection with both the corresponding collector portion 62 and the corresponding tubes 54. As a result, members 68 can be pivoted between the contracted configuration illustrated in FIG. 4 and the expanded configuration illustrated in FIG. 5.

Figure 6:
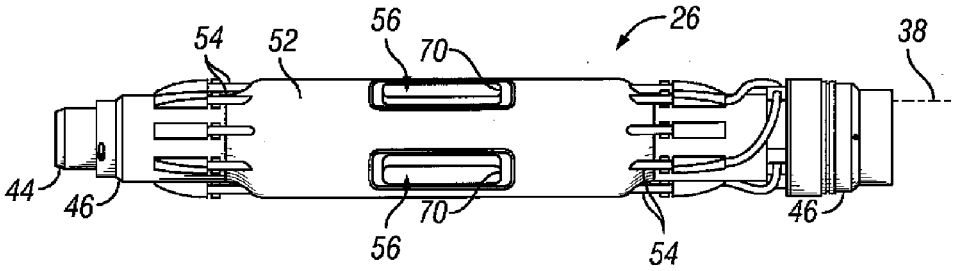
FIG. 6 is a front view of another example of the single packer, according to an alternate embodiment of the present invention.

Referring generally to FIG. 6, another embodiment of single packer 26 is illustrated. In this embodiment, the single packer 26 comprises only sample drains 56. In some applications, sample drains can be used with no guard drains to achieve simpler operation. Depending on the demands of the application, the sample drains 56 may be elongated. Furthermore, in this embodiment and other embodiments, one or more sensors 70 can be employed in packer 26. For example, sensors 70 may be positioned in the sample drains 56, in the flow lines, e.g. tubes 54, or at other flow locations within single packer 26. The sensors 70 also may be positioned in guard drains 58 when used with other embodiments of packer 26. By way of example, sensors 70 are designed to measure dialectic properties of collected fluids and to check fluid compositions. However, sensors 70 also can be designed to detect one or more additional or other characteristics related to the sample fluid.

Viscosity lowering system 38 may be constructed according to a variety of designs. In one embodiment, viscosity lowering system 38 comprises a heater 72, such as an electrical heater, as in the example illustrated in FIG. 7. The heater 72 may be embedded or otherwise positioned in single packer 26 to heat the formation surrounding one or more of the drains 50 to lower the viscosity of the substance, e.g. oil, being sampled. In many applications, ground heating can be difficult and thermal losses may require substantial time for sufficient heating of the formation region. In at least some applications, the outer packer temperature is raised to a relatively high level to dissipate sufficient heating power.

Figure 7:
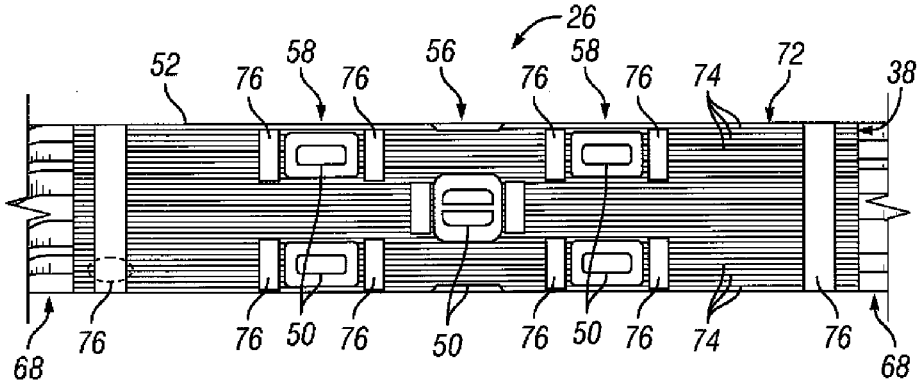
FIG. 7 is a view of one example of the single packer having a viscosity system, according to an embodiment of the present invention.

In the embodiment illustrated in FIG. 7, the heating surface covers a large area to maximize heating efficiency for a given power and to dissipate sufficient energy while keeping the packer outside diameter at a reasonable temperature that avoids modifying the oil composition by chemical reaction. In this example, heater 72 comprises a plurality of heater wires 74 that are able to provide electrical resistance during packer expansion. Additionally, the seal material, e.g. rubber, surrounding the heater wires 74 has a high thermal conductivity. By way of example, the thermal conductivity of the seal layer may be increased by modifying rubber material with fillers, such as carbon black, alumina hydrates powder, or carbon nanotubes. Depending on the structure of packer 26 and the materials employed, the heating system 72 may be spaced from the packer extremities. The spacing can prevent softening of heavy oil in a non-sealed area which, in turn, prevents well fluid infiltration in the formation that would increase the sampling configuration.

Figure 8:
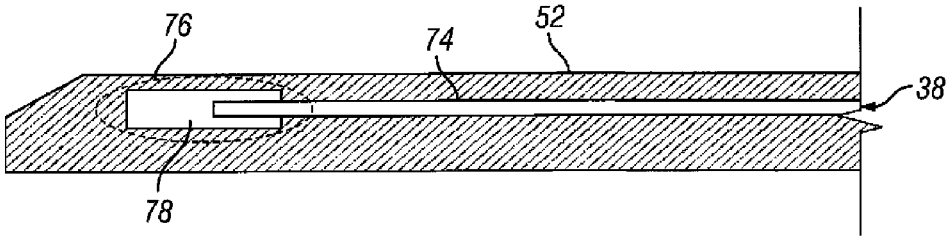
FIG. 8 is an enlarged view of a portion of the single packer illustrated in FIG. 7, according to an embodiment of the present invention.

By way of specific example, the heater wires 74 may be embedded in seal layer 52. In this example, the heater wires 74 are set longitudinally to ensure the wires are not unduly stressed during packer expansion. Additionally, the wire extremities (where the wires make a semi loop) can be located within a cavity 76 formed within the seal material of seal layer 52, as better illustrated in FIG. 8. The cavity 76 may be filled with a material 78, e.g. grease, gel, or fluid, to ensure the heater wires 74 do not incur damage during packer expansion. In this environment, the heater wires 74 do not extend to the seal layer extremities so as to help ensure that heavy oil does not soften in a wellbore area outside the sealed region created by single packer 26.

Figure 9:
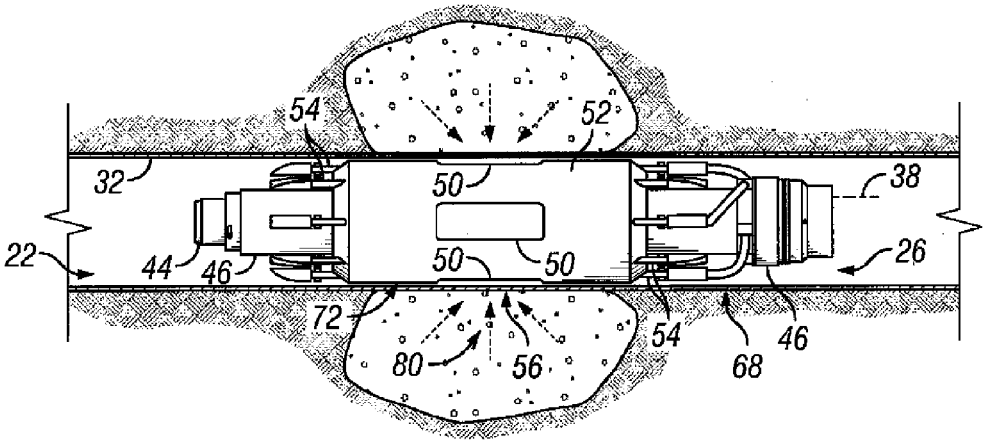
FIG. 9 is a front view of a single packer expanded in a wellbore to collect a fluid sample, according to an embodiment of the present invention.
Figure 10:
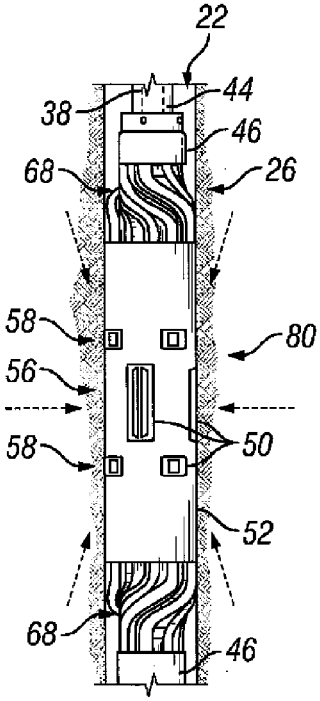
FIG. 10 is another view of a single packer expanded in a wellbore to collect a fluid sample, according to an alternate embodiment of the present invention.

Viscosity lowering system 38 enables heating of the formation extremely close to a desired sampling zone 80, as illustrated in FIG. 9. For example, the formation heating can be concentrated in a region immediately surrounding the sampling drains 56. In other embodiments, fluid can be drawn in through both sampling drains 56 and guard drains 58, as illustrated in FIG. 10. Referring to the embodiment of FIG. 10, when the single packer 26 is inflated, fluid is drawn from the formation through sampling drains 56 and guard drains 58. Contaminated fluid is first collected through all the drains, but soon the contaminated fluid flows only through the guard drains 58, while clean fluid reaches the sample drains 56. In heavy oil environments, heating of sampling zone 80 enables or at least facilitates this sampling process.

Figure 11:
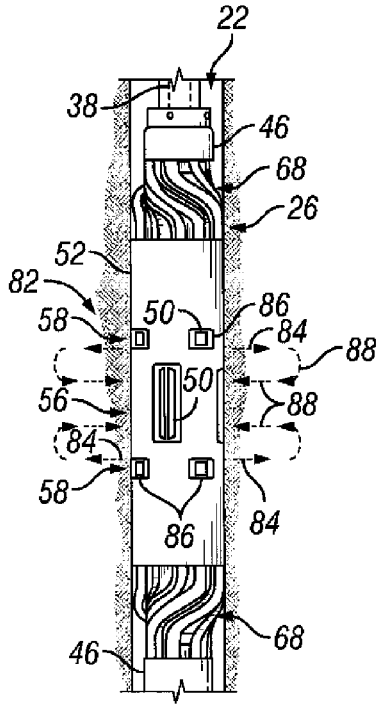
FIG. 11 is a view of a single packer having an alternate viscosity system, according to an embodiment of the present invention.

Referring generally to FIG. 11, single packer 26 is illustrated with an alternate embodiment of viscosity lowering system 38. In this embodiment, viscosity lowering system 38 comprises a fluid injection system 82. The fluid injection system 82 provides an efficient way to reduce the viscosity of, for example, heavy oil by injecting a fluid into the formation while sampling. By way of example, fluid is delivered through single packer 26 and injected into the information in the sampling zone surrounding one or more drains 50, as represented by arrows 84 in FIG. 11. The injected fluid may be a diluent selected to act as a diluting agent for lowering the viscosity of the heavy oil. Alternatively, the injected fluid may comprise steam injected into the surrounding formation to create localized heat for lowering the viscosity. In at least some applications, the drains 50 through which fluid is injected may comprise an injection guard 86.

In the embodiment illustrated in FIG. 11, the fluid injected into the sampling zone is injected through outer drains. The injected fluid mixes with formation fluid and lowers the viscosity of the formation fluid by heat and/or dilution. This facilitates the drawing of fluid samples through sampling drains 56, as represented by arrows 88. By way of example, the injection of hot water or steam can greatly increase the efficiency of the sampling process.

Figure 12:
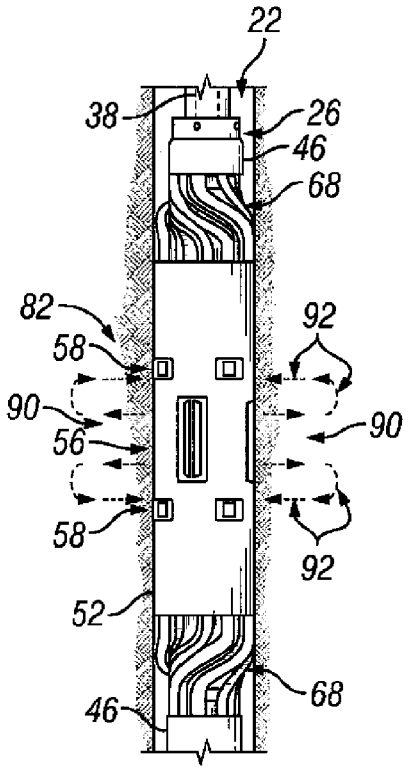
FIG. 12 is a view similar to that of FIG. 11 but showing a variation of the viscosity system, according to an embodiment of the present invention.

Alternatively, fluid injection system 82 can be designed to inject fluid through the central drains 50, previously referred to as the sampling drains 56, as illustrated in FIG. 12. In this embodiment, the injected fluid, represented by arrows 90, again mixes with formation fluid and lowers the viscosity of the formation fluid by heat and/or dilution. However, the drawing of fluid samples is accomplished through the outlying drains, referred to above as the guard drains 58, as represented by arrows 92.

Figure 13:
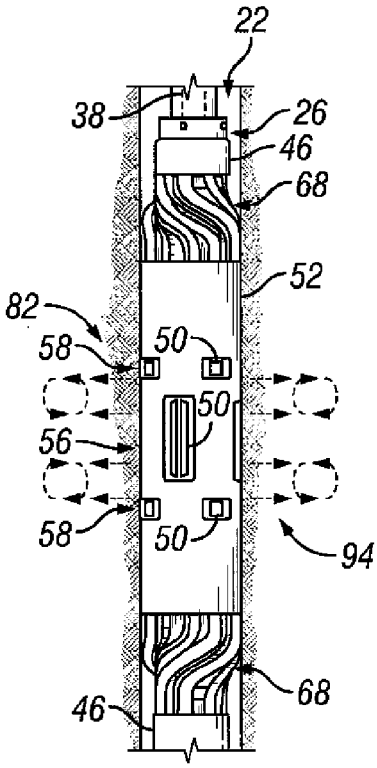
FIG. 13 is a view of a single packer having an alternate viscosity system, according to an embodiment of the present invention.
Figure 14:
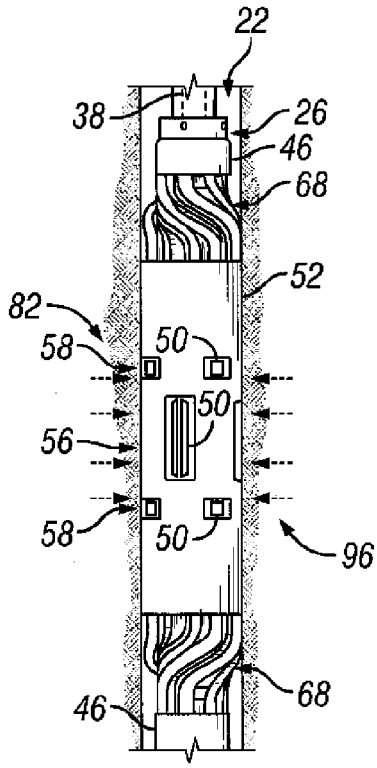
FIG. 14 is a view of a single packer having an alternate viscosity system, according to an embodiment of the present invention.

In another alternate embodiment of the fluid injection system 82, the fluid is injected into the sampling zone through all of the drains 50, as illustrated by arrows 94 in FIG. 13. The injected fluid again mixes with formation fluid and lowers the viscosity of the formation fluid by heat and/or dilution. Upon lowering the viscosity of the desired sample fluid, samples can be drawn in through one or more of the drains 50, as represented by arrows 96 in FIG. 14.

By injecting fluid through all of the drains 50, the viscosity lowering process can be performed with a simplified single packer structure having only one drain zone. Additionally, the injection of fluid can be performed with a single pump combined with appropriate valving in the flow lines to enable successive performance of the injection and drawdown. When single packer 26 is designed for focused sampling, the analyzed or sampled fluid becomes clean faster due to the presence of the guard drains around the sampling drains. This approach maximizes the effect of diluents/hot fluids and enables a shorter injection step by decreasing the amount of sample substance, e.g. heavy oil, that needs to be softened.

Figure 15:
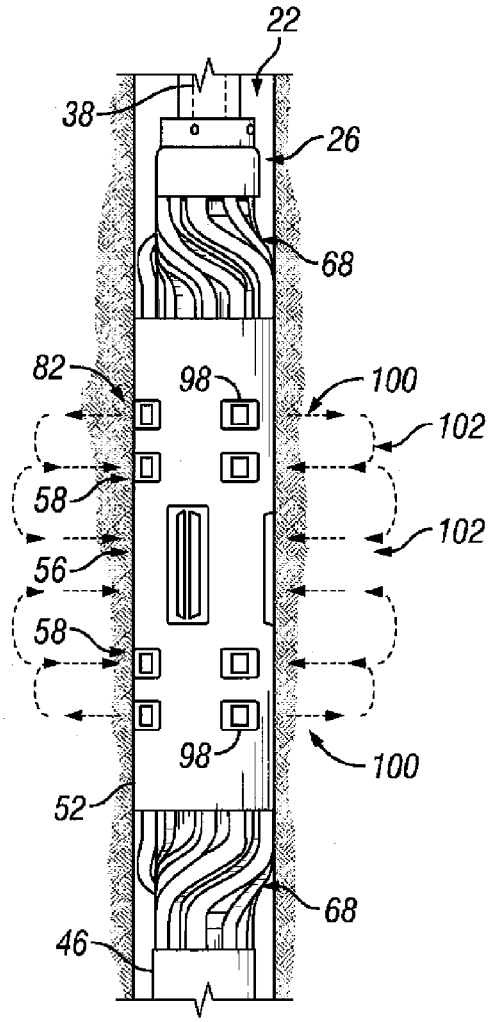
FIG. 15 is a view of a single packer having an alternate viscosity system, according to an embodiment of the present invention.
Figure 16:
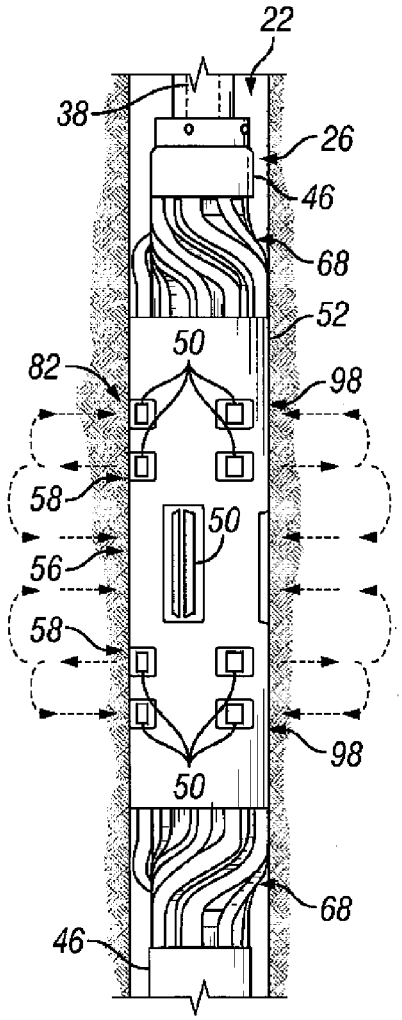
FIG. 16 is a view of a single packer having an alternate viscosity system, according to an embodiment of the present invention.

In another embodiment, an outer set of injector drains 98 is provided for the injection of fluid as represented by arrows 100 in FIG. 15. The injected fluid lowers the viscosity of the formation fluid by heat and/or dilution, which facilitates the drawing of fluid samples through one or more of the sampling drains 56 and guard drains 58, as represented by arrows 102. However, other variations of single packer 26 may route the injection fluids and sampled fluids through different sets of drains 50. As illustrated in FIG. 16, for example, viscosity lowering fluid can be injected through the guard drains 58, and sampled fluids can be drawn in through sample drains 56 and/or injector drains 98. These and other techniques can be used for injecting viscosity lowering fluids and for drawing in the lower viscosity samples from the surrounding formation.

Figure 17:
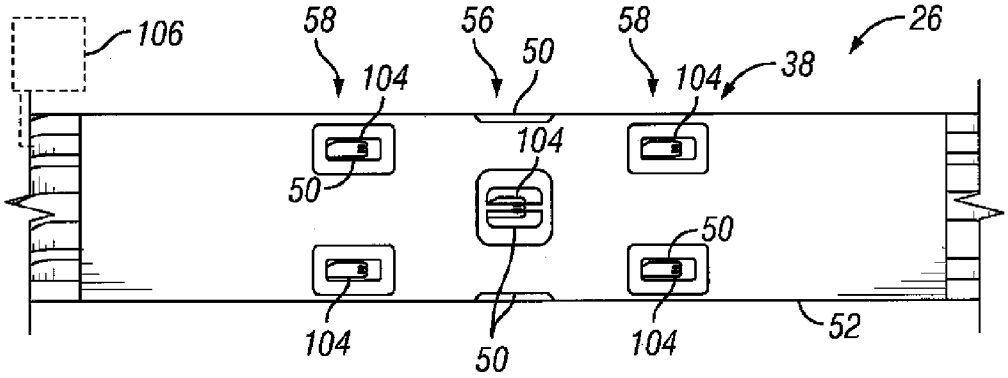
FIG. 17 is a view of a single packer having an alternate viscosity system, according to an embodiment of the present invention.

Referring generally to FIG. 17, another embodiment of single packer 26 is illustrated. In this embodiment, viscosity lowering system 38 comprises a plurality of electrical resistors 104 to heat the injected fluid. The electrical resistors 104 may be deployed in one or more of the drains 50 and/or inside the flow lines connected to drains 50. The resistance temperature of electrical resistors 104 may be controlled by a variety of devices, such as a probe and regulator, a thermostatic bimetal, carry effect, or other suitable devices. Use of electrical resistors 104 enables a simple mechanical design that provides precise control over temperature with no heating duration limit. According to one embodiment, the injected fluid is heated by the electrical resistance inside specific injection drains. This enables heat dissipation near the formation without thermal losses in the flow lines. Additionally, by heating near the formation, the risk of damage to the seals and electronics of the single packer is reduced. If, for example, water is injected, the water is heated as it is discharged to the formation and is therefore not able to create unwanted heat in the packer flow lines during injection. The injection fluid flow can even help limit the heating of certain portions of the packer while focusing the heating at electrical resistors 104. Electrical resistors 104 or other types of heating elements also can be used to maintain heat in the heavy oil sample while in the flow tubes 54 between the formation and a sample chamber.

In addition to the electrical resistors or as an alternative to the electrical resistors, the injection fluid, e.g. water, can be heated using exothermic chemical reactions. The chemical reactions may be created by mixing the desired chemicals in the drains or by delivering the desired chemicals to a common area through adjacent drains.

During some sampling applications, limited power may be available downhole due to, for example, power limitations of the downhole tools. In such applications, one or more batteries 106 can be positioned in the tool string. By way of example, the electrical batteries 106 may be charged during conveyance and used at the beginning of a heating cycle to shorten the heating duration. The need for the supplemental electrical power may be higher at the beginning of the heating process and lower at the end. In such applications, heating during an initial phase may employ battery power combined with electrical power provided through, for example, a logging cable. This enables greater heating than otherwise possible via the downhole tool power capacity. During a second heating phase, the heating relies on power supplied through the logging cable. In subsequent heating phases, the energy requirements for heating may be below the downhole tool power capacity, and electricity can be provided through the logging cable and/or via battery 106.

Single packer 26 can be designed with a variety of viscosity lowering systems and used according to a variety of sampling techniques. In some applications, for example, expanding, e.g. inflating, the single packer 26 while sampling is beneficial. Expansion of the single pack or 26 can be used to squeeze the surrounding formation which helps ensure that the collected fluid is fully representative of the formation fluid.

Figure 18:
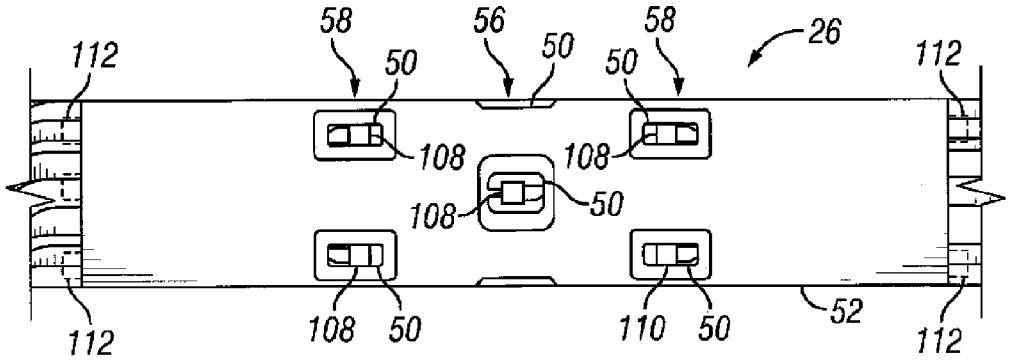
FIG. 18 is a view of a single packer having an alternate viscosity system, according to an embodiment of the present invention.

However, single packer 26 also can employ alternative or additional features to facilitate the lowering of sample fluid viscosity. As illustrated in the embodiment of FIG. 18, single packer 26 may employ one or more microwave emitters 108 which can be operated to direct microwaves in a manner that creates heat. For example, the microwaves can be directed toward the formation or used to heat water or other fluids that are injected into the formation. Additionally, single packer 26 may employ one or more heat sinks 110 designed to maintain heat at desired regions along or within single packer 26. Single packer 26 also may comprise bottles 112 that are coupled to the flow lines and placed near the drains 50 to avoid high pressure differentials in the flow lines. The microwave emitters 108, heat sink 110 and/or bottles 112 can be used alternatively or in combination with other features of the viscosity lowering system 38 that are described herein.

As described above, well system 20 may be constructed in a variety of configurations for use in many environments and applications. The single packer 26 may be constructed from a variety of materials and components for collection of formation fluids from single or multiple intervals within a single expansion zone. Furthermore, single packer 26 may incorporate a variety of viscosity lowering systems having different arrangements of components and features depending on the specific sampling application.

Accordingly, although only a few embodiments of the present invention have been described in detail above, those of ordinary skill in the art will readily appreciate that many modifications are possible without materially departing from the teachings of this invention. Such modifications are intended to be included within the scope of this invention as defined in the claims.

What is claimed is:

1. A system for use in a wellbore comprising:

a single packer having:

an outer structural layer expandable in a wellbore across an expansion zone, the outer structural layer comprising at least one drain within the expansion zone;

an inflatable bladder disposed within the outer structural layer;

a fluid injection system to inject a substance into the expansion zone via the least one drain to lower the viscosity of a fluid being sampled.

2. The system as recited in claim 1, wherein the substance comprises a diluting agent, and further wherein the fluid is formation fluid.

3. The system as recited in claim 1, wherein the substance is steam.

4. The system as recited in claim 1, wherein the outer structural layer comprises at least two drains and further wherein the fluid injection system injects the substance into the at least two drains.

5. The system as recited in claim 1, wherein the fluid injection system comprises an electrical resistor to heat the substance.

6. The system as recited in claim 5, wherein the electrical resistor is positioned within a flowline connected to the at least one drain.

7. The system as recited in claim 1, wherein the fluid injection system comprises an exothermic chemical reaction to heat the substance.

8. The system as recited in claim 7, wherein the exothermic chemical reaction occurs by mixing the substance and at least one chemical in a flowline connected to the at least one drain.

9. The system as recited in claim 7, wherein the outer structural layer comprises at least two drains, and further wherein the exothermic chemical reaction occurs at a location between the at least two drains.

10. A method, comprising:

deploying a single packer into a wellbore, the single packer having a first drain for receiving formation fluid;

expanding the single packer against a wall of the wellbore to create a seal to substantially prevent fluid communication between an area above the single packer and an area below the single packer; and injecting a substance through the first drain or a second drain to lower a viscosity of formation fluid about the wellbore.

11. The method as recited in claim 10, further comprising positioning an inflatable bladder within an outer structural layer to enable selective expansion of the single packer.

12. The method as recited in claim 10 wherein the substance is a diluting agent, water or steam.

13. The method as recited in claim 10 further comprising heating the substance prior to injecting the substance through the first drain or the second drain.

14. The method as recited in claim 10 wherein the first drain and the second drain are formed in an outer layer of the single packer and each connected to a respective flowline and further wherein the first drain and the second drain receive formation fluid.

15. The method as recited in claim 10 further comprising detecting a property of the formation fluid with a sensor positioned in the first drain or the second drain.

16. A method, comprising:

providing a single expandable packer with a drain in an outer seal layer;

delivering the single expandable packer downhole into a wellbore;

expanding the single expandable packer against a surrounding wellbore wall;

lowering the viscosity of a fluid to be sampled by injecting a substance into the wellbore; and intaking the fluid through the drain.

17. The method as recited in claim 16, wherein lowering comprises delivering the substance through the drain to dilute an oil in a formation adjacent to the drain.

18. The method as recited in claim 16, wherein lowering comprises delivering the substance through the drain to heat an oil in a formation adjacent to the drain.

19. The method of claim 16 wherein the substance is injected through the drain that intakes the fluid.

20. The system as recited in claim 16 further comprising heating the substance prior to injecting the substance into the wellbore.

* * * * *